United States Patent [19]

Kaler

[11] Patent Number: 4,883,385

[45] Date of Patent: Nov. 28, 1989

[54] LOAD TRANSFER ASSEMBLY

[75] Inventor: Mark K. Kaler, Kettering, Ohio

[73] Assignee: Dayton Superior Corporation, Miamisburg, Ohio

[21] Appl. No.: 341,262

[22] Filed: Apr. 20, 1989

Related U.S. Application Data

[63] Continuation of Ser. No. 182,273, Apr. 15, 1988, abandoned.

[51] Int. Cl.[4] ..... E01C 11/02

[52] U.S. Cl. ..... 404/47; 404/56

[58] Field of Search ..... 404/47, 51, 52, 56, 404/59-63, 133-135; 52/396, 573, 633, 645, 677, 684

[56] References Cited

U.S. PATENT DOCUMENTS

| | | | |
|---|---|---|---|
| 2,062,654 | 12/1936 | Jacobson et al. | 404/51 |
| 2,127,973 | 8/1938 | Isett | 404/56 |
| 2,187,912 | 1/1940 | Peirce | 404/56 |
| 2,352,673 | 7/1944 | Westcott | 404/56 |
| 2,627,793 | 2/1953 | White | 404/62 |
| 3,045,565 | 7/1962 | Nettleton | 404/59 |
| 3,242,831 | 3/1966 | Crone | 404/61 |
| 3,260,175 | 7/1966 | Crone | 404/61 |
| 4,648,739 | 3/1987 | Thomsen | 404/2 |
| 4,733,513 | 3/1988 | Schrader et al. | 404/56 X |

FOREIGN PATENT DOCUMENTS

| | | | |
|---|---|---|---|
| 1916376 | 10/1970 | Fed. Rep. of Germany | 404/56 |

*Primary Examiner*—Jerome W. Massie
*Assistant Examiner*—Gay Ann Spahn
*Attorney, Agent, or Firm*—Biebel, French & Nauman

[57] ABSTRACT

In the construction of concrete pavement on a roadbed by a continuous concrete paving machine, the end of a section of the pavement is finished off by setting on the roadbed an assembly comprising a plurality of elongated coupling members connected together in spaced parallel relation, with each of these coupling members having releasably secured therein a dowel of a hard plastic material which projects downstream from the associated coupling member. After this assembly has been embedded in freshly laid payment and the paving operation is terminated, the new pavement is saw cut along a vertical plane intersecting the plastic dowels, and the concrete containing the cut off dowel portions is removed. The dowel stubs in the resulting end face of the pavement are than removed and replaced by steel dowels which project beyond the end face of the pavement section for embedding in the next section of pavement to be laid in order to serve as load transfer means between the two pavement sections.

11 Claims, 2 Drawing Sheets

LOAD TRANSFER ASSEMBLY

This is a continuation of co-pending application Serial No. 182,273, filed Apr. 15, 1988, now abandoned.

BACKGROUND OF THE INVENTION

This invention relates to concrete pavement construction, and it has particular relation to the provision of means for transferring load between contiguous sections of concrete pavement which are laid at different times by a continuous pavement laying machine commonly known as a paver.

More specifically, when concrete pavement is laid down on a prepared roadbed by a paver, the machine usually operates continuously throughout each working day. For example, the machine may be proportioned to lay a continuous strip of pavement equal in width to a conventional traffic lane, i.e. 12 feet, and if the pavement is of the reinforced type, the machine may also include means for depositing the reinforcing in the roadbed for embedding in the concrete laid down thereon.

The concrete mix used with machines of this type is commonly of such low slump that slip forms are used along the side edges of the strip, because the stiff concrete mix is sufficiently stiff to hold the edge formations imparted thereto by slip forms carried by the machine. However, the same condition of the absence of forms creates a problem in providing an appropriate junction between the sections of the pavement strip laid during different working sessions.

BRIEF DESCRIPTION OF THE INVENTION

In the customary operation of pavement laying machines as outlined above, the machine lays the concrete to form continuous pavement of a predetermined vertical thickness and width throughout each working session. However, it is not possible to finish the end of the strip with a vertical edge, or to maintain uniform pavement profile at the end of a working session, because as the concrete hopper on the mahine is emptied, the flow rate of concrete diminishes so that the end of a strip is a section of continuously decreasing thickness extending for two or more feet beyond the strip of uniform thickness.

The primary purpose of the present invention is to provide means for finishing off the end of the uniformly thick section of pavement and at the same time to provide for the transmission of load between that section and the adjacent section which is laid during the next working session in such manner as to prevent vertical movement between these adjacent sections.

In accordance with the invention, there is provided an assembly comprising a plurality of coupling members, each of which has a socket at the front end thereof. These coupling members are attached together in spaced parallel relation to form an assembly provided with legs by which it is supported on a roadbed with the coupling members defining a substantially horizontal plane aligned with a vertically intermediate location in the pavement being laid on the roadbed and with the socket ends of the coupling members defining a vertical plane extending at right angles to the length of the pavement strip. Each of these coupling members has a dowel releasably secured in its socket and projecting therefrom, and these dowels are made of any material, such as a hard platic, susceptible of being readily cut off by a saw capable of cutting concrete.

This assembly is set on the roadbed in a position which is calculated to coincide with a location in the operation of the pavement machine just prior to the final emptying of its concrete hopper which will result in a reduction in thickness of the pavement being laid. The position of the assembly is accurately marked, and after the working session is over and the concrete is partially set, the pavement is saw cut in a vertical plane which will intersect the dowels projecting from the coupling member assembly so as to cut off most of the projecting portions of these dowels along with the scrap portion of pavement, which is then removed.

This will leave the cut stub ends of the dowels aligned with the face of the completed section of pavement, and they can then readily be removed from the sockets in the embedded coupling members and replaced by metal dowels of enough greater length to project beyond the end of the pavement section. Then at the beginning of the next working session, these projecting dowel portions will be embedded in the next section of pavement so that they can transfer load between the two sections without allowing relative vertical movement thereof, but while still providing for relative lengthwise movement of the adjacent pavement sections.

Further details of the invention are pointed out in the course of the description of a preferred embodiment of the invention which follows.

DESCRIPTION OF THE PREFERRED EMBODIMENT

Figure 3:
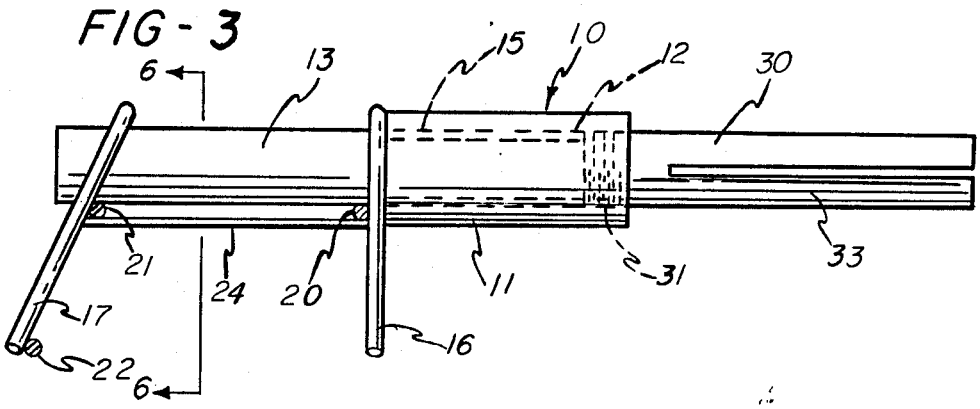
FIG. 3 is a section on the line 3—3 of FIG. 4 and on a larger scale than FIG. 4.

The invention is preferably embodied in an assembly 10 comprising a plurality of coupling members 11. As shown in FIG. 3, each coupling member 11 is a barrel-like member which may be of cylindrical section but is preferably of hexagonal or other polygonal section to prevent it from turning after being embedded in concrete. Each coupling member 11 is provided with an internally threaded socket 12 at its front end.

A steel dowel 13 forms an extension of coupling 11 at the opposite end from socket 12 and may be integral therewith, but it is more readily made as a separate part having a threaded end by which it is secured in an internally threaded socket 15 at the rearward end of coupling 11. The dowel 13 has a supporting leg 16 of inverted V-shape welded thereto adjacent its threaded end, and a similarly inverted V-leg 17 is welded to the other end of dowel 13 in inclined relation with the length of the dowel.

Figure 4:
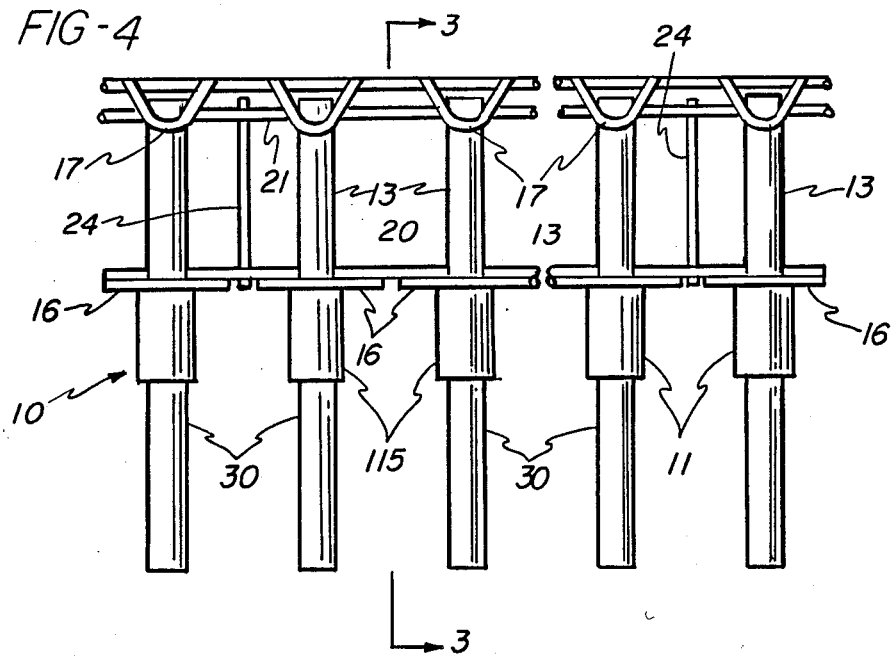
FIG. 4 is a plan view of an assembly of coupling members and dowels in accordance with the invention.
Figure 6:
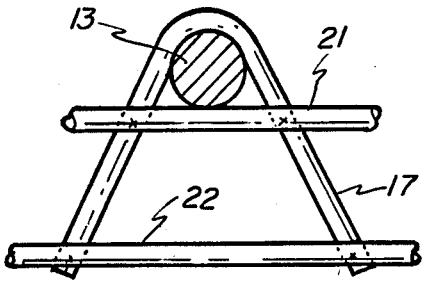
FIG. 6 is a section on the line 6—6 in FIG. 3.
Figure 7:
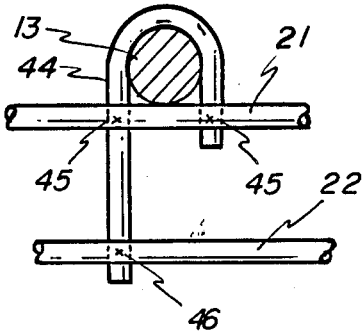
FIG. 7 is a view similar to FIG. 6 showing an alternate construction.

As best shown in FIG. 4, a plurality of assembled couplings 11 and dowels 13 are connected together in spaced parallel relation by means of a plurality of rods welded to the dowels or to their supporting legs. More specifically, a rod 20 is welded to each leg 16 as shown in FIG. 6, and may be also welded to dowel 13. A second rod 21 is similarly welded to the legs 17 and may also be welded to the dowel, and a third rod 22 is welded to the ends of each of the legs 17. In addition, short lengths of rod 24 are welded to the rods 20 and 21 in parallel relation with dowels 13.

The width of each assembly 10 is determined by the width of the pavement with which it is used. For example, for use in constructing a section of pavement 12 feet wide, the complete assembly as shown in FIG. 4 may comprise twelve couplings 11 and dowels 13 arranged on 12-inch centers, to provide a 6-inch space between each end of the assembly and the adjacent edge of the pavement.

Figure 5:
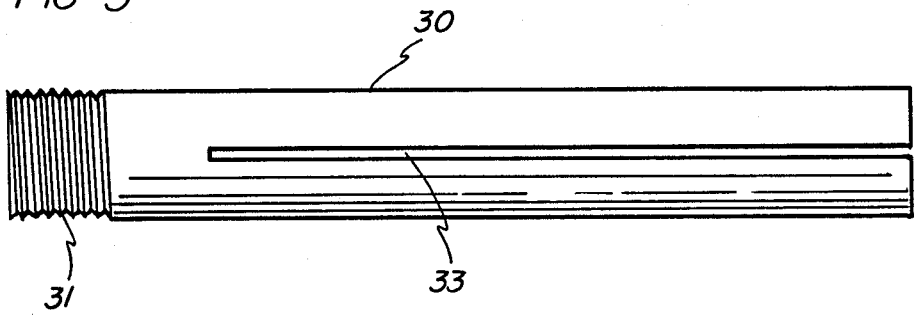
FIG. 5 is a detail view of one of the dowels shown in FIGS. 3 and 4.

The key element of the apparatus of the invention is a dowel 30 having a threaded end portion 31 by which it is secured in the socket 12 of a coupling 11. As shown in FIG. 5, the end of dowel 30 opposite its threaded end is provided with a centrally located longitudinal slot 33 of sufficient length that when the dowel is threaded into a socket 12, the inner end of the slot 33 will be approximately in line with the front end of the coupling 11. Each dowel 30 is formed of a material susceptible to ready cutting by any saw capable of cutting concrete pavement, such preferably as any plastic, e.g. polyethylene, of sufficient hardness for external threading. The length of each dowel 30 is not important, since much of it will be cut off in the course of its use, and as a practical matter, it may be as long as dowel 13, i.e. 9 inches, or as short as 4 inches.

Figure 1:
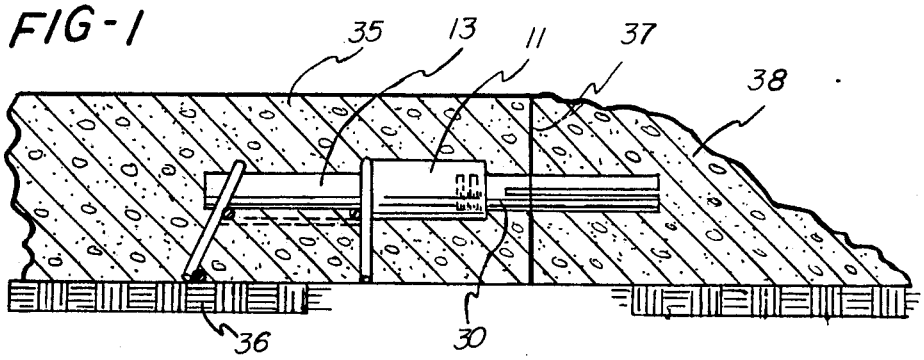
FIG. 1 is a somewhat diagrammatic view in vertical section illustrating the use of the apparatus of the invention at the end of a section of concrete pavement as it appears immediately after the end of an operating session of a pavement laying machine.

The use of the assembly 10 of the invention is illustrated in FIG. 1 in conjunction with the laying of concrete pavement 35 on a prepared roadbed 36. As previously noted, the paving machines with which the invention is used operate continuously for an extended period which normally occupies a full day. At the end of each such working session, the machine operators determine the location along the roadbed at which the concrete hopper on the machine will be emptied, and before the machine reaches that location, one of the assemblies 10 will be set on the roadbed 36 in such position that it extends across the roadbed at right angles to the length of the pavement section being laid thereon.

The assembly is therefore embedded in the fresh concrete 35, as illustrated in FIG. 1, at a position as close as possible to the location where the thickness of the pavement begins to diminish because of the emptying of the concrete hopper on the machine. This condition is illustrated in FIG. 1, and it is allowed to continue until substantial setting of the concrete has taken place, e.g. three to four hours.

When the assembly 10 is set in position on the roadbed, its precise location is marked at the opposite sides of the pavement section, in order to establish a vertical plane which will intersect all of the plastic dowels 30 near but spaced from the ends of the couplings 11 to assure that the cut will intersect the slotted portions of the dowels 30. The pavement is then cut off, by a suitable concrete cutting saw, along this vertical plane, as indicated at 37 in FIG. 1, thereby cutting off some of each plastic dowel 30, and these cut off portions remain in what is now scrap concrete 38 which is either taken away or spread along the roadbed so that it is covered by fresh concrete when the next working session begins.

Figure 2:
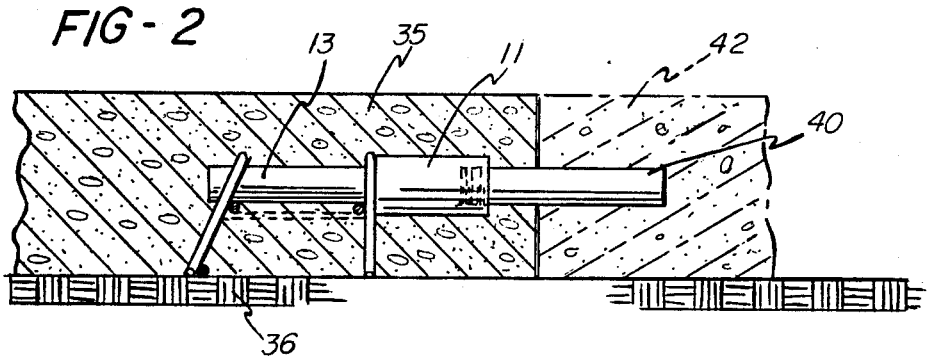
FIG. 2 is a view similar to FIG. 1 showing the end of the pavement section when it is ready for the laying of the adjacent section.

At this stage of the operation, the completed pavement section will have a vertical end face which will include the cut ends of all of the plastic dowels 30. These dowel stubs are then removed, which is readily done by means of any screw driving tool inserted in the remainder of the slot 33 in each dowel. After the plastic dowel stubs have been removed, they are replaced by steel dowels 40 of appropriate length, e.g. 9 inches, which will project beyond the end face of the pavement as shown in FIG. 2. The section of pavement laid during the next working session will butt the previous day's section and thereby embed the projecting steel dowels 40, which will serve as the load transferring means between the two adjacent pavement sections after completion of the next section, which is represented in broken lines at 42 in FIG. 2. However, since the dowels 40 are straight, as well as cylindrical, they do not interfere with relative movement of the adjacent pavement sections 35 and 42 lengthwise of the pavement.

The proportions of the component parts of the assembly 10 are not critical, except for the fact that the steel dowels 40 must project sufficiently beyond the cut face of pavement section 35 into the next section 42 to effect proper transfer of loads therebetween. Satisfactory results are obtainable in this respect for substantially all pavement laying operations with couplings 11 which are 4.125 inches long and with the dowels 13, 30 and 40 all 9 inches in length, although the plastic dowels 30 may be as short as 4 inches. The diameter of individual dowels depends on the thickness of the pavement, a satisfactory dimension being 1.25 inches for pavement less than 11 inches in thickness and 1.50 inches for thicker pavement, with the couplings 22 approximately one-half inch greater in diameter than their associated dowels.

The lengths of the legs 16 and 17 are subject to variation depending upon the thickness of the pavement in which they are embedded. The preferred practice is to have these legs of such selected length that they support couplings 11 and their associated dowels at approximately the vertical center of the pavement.

FIG. 6 illustrates an alternative construction of leg which may be used in place of the inverted V-legs, particularly for assemblies 10 for use in pavement of a thickness range of 15 inches or less. In FIG. 6, the leg 44 is of inverted J-shape to provide a loop at the top which fits over the dowel 13 and is welded at two points 45 to the cross rod 20 and has its lower end welded at 46 of the cross rod 22. Similar inverted J-shaped rods may be used adjacent the threaded ends of the dowels 13, by a pair of welded connections to the cross rod 20.

While the method herein described, and the forms of apparatus for carrying this method into effect, constitute preferred embodiments of this invention, it is to be understood that the invention is not limited to this precise method and forms of apparatus, and that changes may be made in either without departing from the scope of the invention, which is defined in the appended claims.

What is claimed is:

1. Apparatus for use in the construction of concrete pavement of predetermined thickness laid without stationary forms by a paving machine to transfer load lengthwise of said pavement across a predetermined vertical plane defined by the adjacent ends of two sections of said pavement laid at different times while providing for relative lengthwise movement of said pavement sections in use, comprising:

(a) a plurality of elongated coupling members each having a socket at the front end thereof, (b) each of said coupling members having a straight cylindrical dowel releasably secured in said socket therein and projecting therefrom, (c) means for attaching said coupling members together in spaced parallel relation with said front ends thereof defining a common vertical plane, (d) means to be embedded in the first of said sections to be laid for supporting said attached coupling members on a roadbed with said coupling members and dowels defining a substantially horizontal plane aligned with a vertically intermediate location in said pavement and with said vertical plane defined by said coupling member ends extending substantially parallel with and in spaced relation with said predetermined vertical plane such that a portion of each of said dowels extends through said predetermined vertical plane, (e) said supporting means being constructed and arranged to stand on said roadbed in spaced relation with said predetermined vertical plane and to support said dowels projecting therefrom in cantilevered fashion through said plane, and (f) said dowels being of a material susceptible to being readily cut off by a saw capable of cutting concrete whereby upon saw cutting said pavement along said predetermined vertical plane, the cut ends of said dowels will be exposed in the end of the resulting pavement section for removal from said coupling members and replacement thereof in said sockets by straight cylindrical dowels projecting from said pavement section for embedding in the next pavement section to be laid.

2. Apparatus as defined in claim 1 wherein said supporting means comprises leg means secured to each of said coupling members in spaced relation with each other and with said front end of the associated said coupling member.

3. Apparatus as defined in claim 1 wherein said attaching means comprises rod means extending at right angles to said coupling members and secured to each thereof.

4. Apparatus as defined in claim 2 wherein said attaching means comprises rod means extending at right angles to said coupling members and secured to said leg means.

5. Apparatus as defined in claim 1 wherein the first named said dowels are formed of a resin material.

6. Apparatus as defined in claim 1 wherein said socket in each of said coupling members is internally threaded, and each of said dowels includes a threaded end portion by which it is releasably secured in the associated said socket.

7. Apparatus as defined in claim 6 wherein each of said first named dowels has a slot extending longitudinally thereof from the end thereof opposite said threaded end for receiving screw driving means therein to facilitate removal thereof from the associated said socket following said saw cutting operation.

8. Apparatus as defined in claim 1 wherein said attaching means comprises rod means secured to each of said coupling members, and said supporting means comprises leg means secured to each of said coupling members and of predetermined length for supporting said attached coupling members on a roadbed with said coupling members.

9. In a method of finishing the end of a section of concrete pavement of predetermined thickness and length laid without stationary forms on a roadbed by a paving machine to provide for the transfer of load lengthwise of said pavement across a vertical plane defined by the ends of said section and of the adjacent subsequently laid section while providing for relative lengthwise movement of said pavement sections in use, the steps of:

(a) establishing the location on said roadbed of said predetermined vertical plane, (b) setting on said roadbed in advance of said paving machine an assembly comprising a plurality of elongated coupling members connected together in spaced parallel relation and each having a socket at the front end thereof having releasably secured therein a straight cylindrical dowel of a material susceptible to being readily cut off by a saw capable of cutting concrete, said assembly also including means for supporting said coupling members and dowels in cantilevered fashion in parallel relation with the length of said pavement and in substantially horizontal alignment with a vertically intermediate location in said pavement, (c) establishing said assembly in such position on said roadbed that said coupling members and a portion of each of said dowels are on the side of said predetermined vertical plane facing said pavement section while the outer end portion of each of said dowels projects beyond said plane, (d) continuing the laying of concrete on said roadbed until said assembly is entirely embedded in concrete of said predetermined thickness on both sides of said predetermined vertical plane, (e) after said concrete has partially set, saw cutting said pavement along said vertical plane to cut off so much of said concrete and of each said dowel as extends beyond said plane, (f) clearing the resulting scrap concrete and dowel pieces from the area adjacent said vertical plane to expose the end of said section and the cut ends of said dowels, (g) removing the remaining portions of said dowels from said coupling members, and (h) securing in each of the resulting empty sockets a metal straight cylindrical dowel of sufficient length to project beyond said vertical plane for embedding in the next section of pavement to be laid on said roadbed.

10. The method defined in claim 9 wherein the first named dowels are formed of a resin material.

11. The method defined in claim 9 wherein said socket in each of said coupling members is internally threaded, each of said first named dowels includes a threaded end portion by which it is releasably secured in the associated said socket, and each of said releasably secured dowels has a slot extending longitudinally thereof from the end thereof opposite said threaded end for receiving screw driving means therein to facilitate removal thereof from the associated said socket following said saw cutting operation.

* * * * *